United States Patent [19]

Bergmann et al.

[11] 4,417,456

[45] Nov. 29, 1983

[54] THREAD POSITIONING APPARATUS FOR A WARP KNITTING MACHINE

[76] Inventors: Gerhard Bergmann, Frankfurter Strasse 41, 6053 Obertshausen; Erhard Henz, Friedhofstrasse 56, 6056 Heusenstamm, both of Fed. Rep. of Germany

[21] Appl. No.: 275,703

[22] Filed: Jun. 22, 1981

[30] Foreign Application Priority Data

Jun. 26, 1980 [DE] Fed. Rep. of Germany ..... 3023952

[51] Int. Cl.[3] ..... D04B 27/02

[52] U.S. Cl. ..... 66/214

[58] Field of Search ..... 66/203, 204, 207, 214

[56] References Cited

U.S. PATENT DOCUMENTS 2,418,445 4/1947 Amidon ..... 66/214

3,099,921 8/1963 Liebrandt ..... 66/214

FOREIGN PATENT DOCUMENTS 51-23624 7/1970 Japan ..... 66/214

1864 of 1890 United Kingdom ..... 66/214

*Primary Examiner*—Ronald Feldbaum

[57] ABSTRACT

A warp knitting machine has a needle bed and a jacquard arrangement for producing patterned wear from a plurality of threads. The machine includes a thread positioning bar and a plurality of thread positioning sinkers mounted on the thread positioning bar. The sinkers are spaced to allow the sinkers to pass between the needles of the bed. The machine also includes at least one guide bar and a plurality of thread guides mounted on each guide bar for separately guiding the threads. The thread guides are operable by the jacquard arrangement to move longitudinally relative to said guide bar and with a component of motion in a plane alongside the needle bed. This component is sized to allow each of the threads to reciprocate between and be pulled against the interior sides of a corresponding, neighboring pair of the sinkers.

10 Claims, 8 Drawing Figures

THREAD POSITIONING APPARATUS FOR A WARP KNITTING MACHINE

BACKGROUND OF THE INVENTION

1. Field of the Invention

The present invention relates to warp knitting machines and, in particular, to machines having a jacquard arrangement.

2. Discussion of the Relevant Art

The invention concerns warp knitting machines for producing patterned goods. This machine has thread guides which are movable by a jacquard arrangement along their longitudinal axis at an acute angle relative to the guide bar carrying them.

In a known warp knitting machine of this type (U.S. Pat. No. 3,099,921) the thread guides having eyelets, are caused to move in a vertical plane. Threads run directly from the eyelet of the guides to the needle bed. Since the eyelet of the guide has a determinable height with respect to the needle bed during the swinging motion of the guide bar, the thread may be placed in a determinable passage between the needles. Unfortunately, it has been observed that many pattern errors occur at this step. These errors increase in proportion to the speed of the machine and the narrowness of the gap between the needles.

U.S. Pat. No. 3,834,193 discloses the use of thread guides which are laterally displaced by interaction with jacquard controlled dropper bars. However, with this technique similar pattern errors also occur.

A further type of warp knitting machines is known (DE-PS No. 1585536) wherein each needle passage is provided with a thread positioning sinker having an angled surface on its leading edge which has the task of laying the threads, which run diagonally in front of the needles, directly into the appropriate needle passage. The threads are led via eyelets in steel bands whose sideward displacement produces the pattern. Unfortunately, the number of patterning possibilities in this mode is limited and may only be increased by the provision of a substantial number of steel bands. It also has been noted that the diagonal portion of the sinker causes substantial damage to the threads by friction, sideward displacement and cutting.

U.S. Pat. No. 2,480,231 further discloses an alternative for the thread guide and is eyelet which avoids running the thread through an S-shaped path. This mode utilitzes thread guiding sinkers in the form of an upwardly open hook wherein the free ends of the hooks are protected by a U-shaped rail.

SUMMARY OF THE INVENTION

Therefore, it is one object of the present invention to provide a warp knitting machine arranged in such a way as to avoid the patterning errors heretofore observed with jacquard controlled thread guides.

It is another object of the present invention to provide a reciprocatable thread guide moving relative to a needle bed and to thread positioning sinkers in such a way that threads are rapidly and accurately laid between adjacent needles.

A warp knitting machine according to the principles of the present invention has a needle bed and a jacquard arrangement for producing patterned wear from a plurality of threads. The machine also has a thread positioning bar and a plurality of thread positioning sinkers mounted on the thread positioning bar. The sinkers are spaced to allow the sinkers to pass between the needles of the needle bed. The machine also includes at least one guide bar and a plurality of thread guides mounted on each guide bar. The guides can separately guide the threads and can be operated by the jacquard arrangement to move longitudinally relative to the guide bar, with a component of motion in a plane alongside the needle bed. This component is sized to allow each of the threads to reciprocate between and be pulled against the interior sides of a corresponding, neighboring pair of the sinkers.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENT

Figure 1:
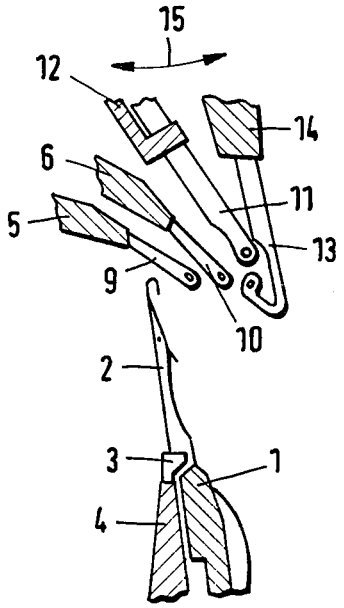
FIG. 1 is a cross sectional view through the working portion of a warp knitting machine according to the teachings of the present invention.

Referring to FIG. 1, the working area of a warp knitting machine is shown including a needle bar 1 supporting a plurality of latch needles 2 (one of them being illustrated). A plurality of knock over sinkers 3 (one of them being illustrated) are attached to a bar 4. Needles 2 can vertically reciprocate in a conventional manner. Two pluralities of thread guides 9 and 10 (one from each plurality being illustrated) are attached to guide bars 5 and 6, respectively, which are arranged to swing past needles 2. A plurality of thread guides 11 (one of them being illustrated) shaped as rods ending with transverse eyelets are slidably mounted in matching holes in guide bar 12. Guides 11 can reciprocate, as described hereinafter, by the action of a jacquard arrangement. A plurality of thread positioning sinkers 13 (one of them being illustrated) are affixed to a thread positioning bar 14. The thread positioning sinkers 13 are provided in the form of an upwardly open hook, whose free end has a rearwardly directed protrusion. As explained further hereinafter, the purpose of the protrusion is to help maintain thread within the hook when guide bar 14 makes a substantial movement, notwithstanding forces from the guides in front of sinkers 13. Sinkers 13 are spaced preferably with the same center to center spacing as needles 2 and guide 11. Bars 5,6,12 and 14 are all mounted so they can swing past needles 2 with the motion indicated by arrow 15.

Figure 2:
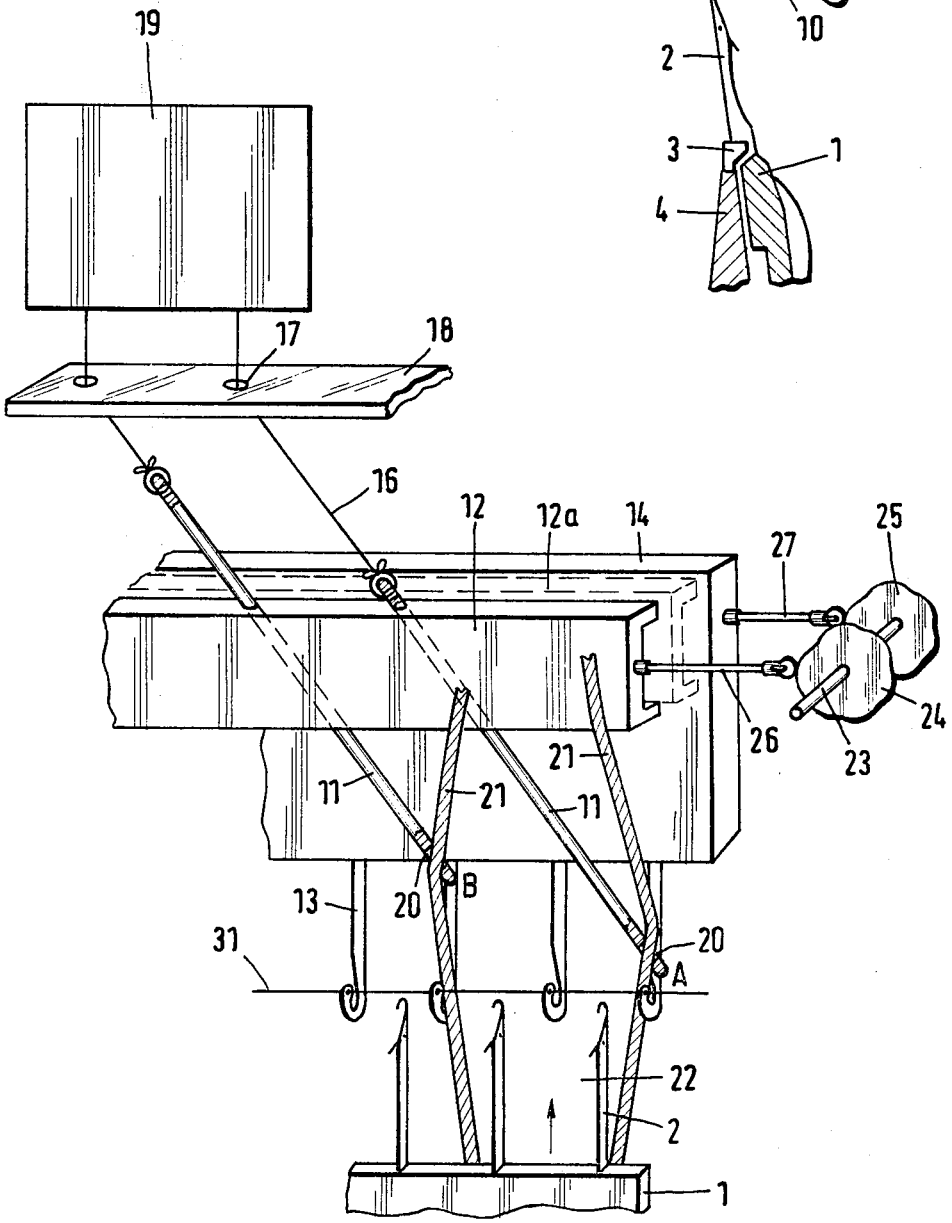
FIG. 2 is a schematic and perspective representation of the working area of FIG. 1 together with a jacquard arrangement.
Figure 2A:
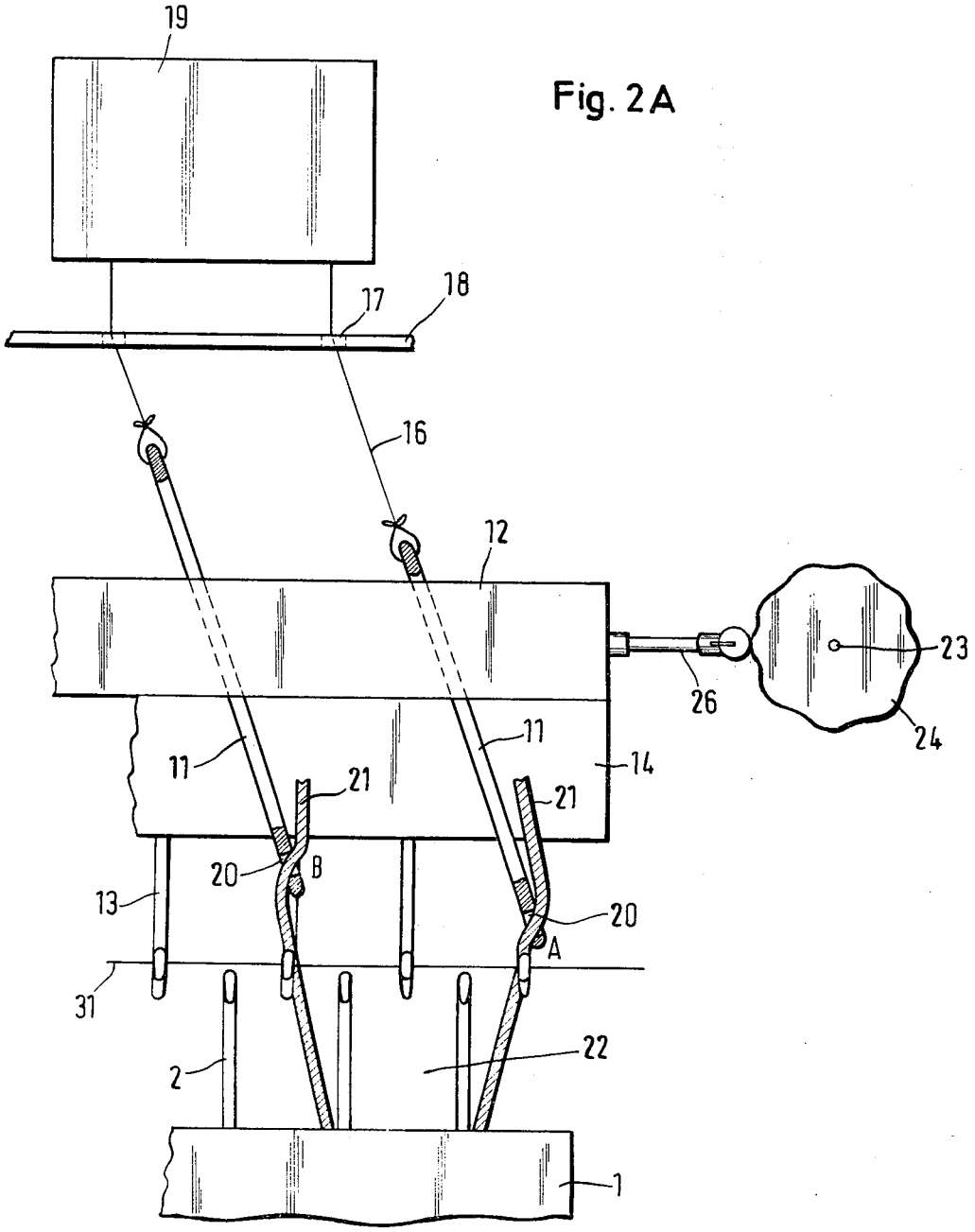
FIG. 2A is an elevational view of the apparatus of FIG. 2.

Referring to FIGS. 2 and 2A, the working area of a warp knitting machine is shown including some of the apparatus of FIG. 1, but excluding guide bars 5 and 6 and their associated guides. Guide bar 12 is a channel-shaped member having a plurality of apertures along both of its legs into which guides 11 are slidably mounted. Guides 11 are laid at an acute angle, preferably 45°, to the length of guide bar 12 so, when moved, they have a component of motion along the axis of needle bed 1.

Threads 21 are shown passing through eyelets 20 of guides 11, between a corresponding space between sinkers 13 and past needles 2. Each of the guides 11 have two extreme positions, illustrated herein as positions A and B. Guides 11 are urged into position A by a spring (not shown) within bar 12. With such construction, threads 21 can be displaced along the longitudinal axis of needle bed 1 by thread guides 11. By this means threads 21 can, to a certain extent, be directed into passages between needles 2. The path constituting the transition of each of the guides 11 from its position A to B, contains a directional component parallel to the longitudinal axis of needle bed 1 of such an order of magnitude that each of threads 21 at one extreme position of thread guide 11 can lay against the side of a given one of thread positioning sinkers 13 and at the other extreme position lay against the side of a neighboring thread positioning sinker facing that given one.

Each of the guides 11 have attached to their upper ends control cords 16 which are colinear with the extension of the longitudinal axis of each of the guides 11. Thus aligned, guides 11 are not biased by a force acting perpendicular to their bearings. Cords 16 run through eyelets 17 of eyelet bar 18 and thereafter terminate in and are controlled by conventional jacquard arrangement 19.

The motion of the jacquard control threads in the eyelet board is no source of problems. Jacquard arrangement 19 can draw or release individual ones of the cords 16 according to a predetermined pattern. By means of jacquard arrangement 19, guides 11 and their eyelets 20 can be moved from lower, right hand position A to upper, left hand position B. By sending guides 11 from position A to B, the associated thread 21 moves from one passage between neighboring needles to the next one on the left (and vice versa).

In the area of the hook of sinker 13, the displacement of thread 21 is not 100% of the inter-needle spacing but somewhat less. The horizontal component of the displacement of guide 11, on the other hand, is somewhat greater than one needle space. Because of their registration with the spaces between needles 2, thread positioning sinkers 13 can readily lead thread 21 between needles 2 and thereby avoid misplacement and patterning errors.

Bars 12 and 14 are mounted so they can reciprocate in a direction parallel to the length of needle bed 1 but are biased to the right by unillustrated springs. Two pattern wheels 24 and 25 having a radius that varies along their circumferences are mounted on a common shaft 23 which rotates in proportion to the number of knitting cycles of the machine of FIG. 2. Push rods 26 and 27 are mounted on bars 12 and 14, respectively, and terminate in rollers. The rollers of push rods 26 and 27 ride the periphery of pattern wheels 24 and 25, causing the bars to move in a predetermined pattern. The extent of travel produced by wheels 24 and 25 can be one or more needle spaces. In particular cases, it may be desirable to displace positioning bar 14 with respect to the guide bar 12 a predetermined amount. This has the consequence that all of the threads are laid on the same side of the appropriate sinkers 13 irrespective of whether guides 11 are in position A or B.

For some embodiments the additional guide bar 12*a*, shown herein in phantom, can be employed. Second guide bar 12*a* is also provided with jacquard controlled, angled, thread guides (not shown) and is similarly controlled by a pattern wheel and push rod, neither of which are illustrated. In these circumstances, the separate threads handled by bars 12 and 12*a* can be positioned by the same sinkers 13, one sinker possibly receiving more than one thread. Thus bar 12*a*, having the same structure as bar 12 makes it possible for sinkers 13 to operate not only the system of threads 21 but a second entirely independent thread system.

The motion produced by the jacquard arrangement is equivalent to moving threads 21, one needle space. This displacement can be in addition to the motion provided to the guide bar itself by pattern wheels 24 and 25. This thus provides a multiple patterning possibility. An even greater choice is provided by the use of additional guide bars 12*a* with jacquard-controlled guides.

It is clear that the range of travel of the thread guide 11 can be kept rather small. It can, in fact, be reduced to the order of about 8 mm so that it is possible to work even with rather high machine speeds.

Figure 3:
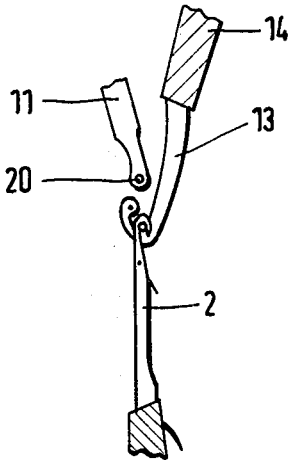
FIG. 3 is a detailed cross sectional view of a portion of the apparatus of FIG. 1 showing the thread guide in its lowest position during the passage of the hook of the sinker through the needle passage.
Figure 4:
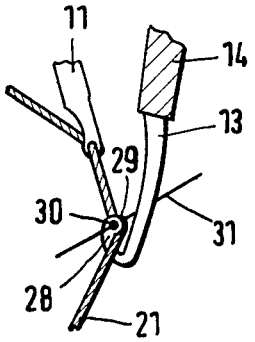
FIG. 4 is another detailed cross sectional view of a portion of the apparatus of FIG. 1, showing the thread guide raised at the peak of its swing.

Thread positioning sinker 13 has the form of a hook 28 having an upwardly directed opening (FIGS. 3 and 4) and a rearwardly directed protrusion 29 at its free end. An eyelet 30 is provided in this protrusion through which wire 31 may be run along the entire breadth of the machine to provide additional security against thread misplacement. The protrusion assists in holding thread 21 in place when a substantial swing to the right is required. For example, when several guide bars are present and thus the thread 21 is turned through an angle (See FIG. 4). (In contrast, in the position of FIG. 3, the thread (not illustrated) runs to needle 2 without a substantial amount of turning from eyelet 20.) Thread 21 lies in front of bar 12 and behind wire 31. Wire 31, however, is not critical and need not be present in all embodiments. While the purpose of wire 31 is a safeguard against the slipping of the thread from the space between the sinkers 13, the threads are usually pulled into the hook space of sinkers 13 and the wire plays almost no part in setting up a frictional effect.

In operation the thread guides 11 swing between the front and the back of needle bed 1 to execute an lapping or a laying motion about needles 2. To effect such motion, thread guide bar 12 can move laterally a number of needle spaces determined by pattern wheel 24 during the course of the knitting cycle. It is presently assumed that control strings 16 have not retracted thread guides 11 so that each is in its "A" position. It is also assumed that pattern wheel 25 is in an interval wherein push rod 27 does not move. Accordingly, the machine of FIG. 2 can produce knitted goods having a consistent pattern.

In response to patterning action from jacquard arrangement 19, certain ones of the thread guides 11 are drawn causing them to move from position A to B. Consequently, selected ones of threads 21 can shift to an adjacent (left in this view) passage between needles 2. This retraction of guide 11 can change the net motion undertaken by selected threads, thereby altering the texture of the knitted goods at certain positions to produce a predetermined pattern in the wear produced by the machine of FIG. 2. This readjustment by the jacquard arrangement 19 of thread guides 11 can persist for one or more machine cycles and then change again to produce a varying pattern.

It is also desirable that under some circumstances, sinkers 13 move relative to thread guide bar 12 so that all of the threads 21 are driven to the left (or alternatively to the right) side of sinker 13. This results in threads 21 being uniformly distributed throughout the knitted wear and, in effect, overrides any pattern that might otherwise be produced by jacquard arrangement. It will be appreciated, therefore, that the extent to which threads 21 are moved is a combination of the relative motion of guide bars 12 and 14 as well as thread guides 11.

It is important to note that by moving threads 21 against the side of thread positioning sinkers 13, the threads can be accurately held in a predetermined position. Therefore, threads 21 can swing through the spaces between needles 2 accurately and with little chance of thread misplacement. Thus, disturbances ordinarily encountered with jacquard controlled thread guides are avoided since, even at high speeds, such disturbances from the jacquard arrangement are not transferred to that portion of the thread which passes between needles 2 because the thread is held against thread positioning sinkers 13.

Figure 5:
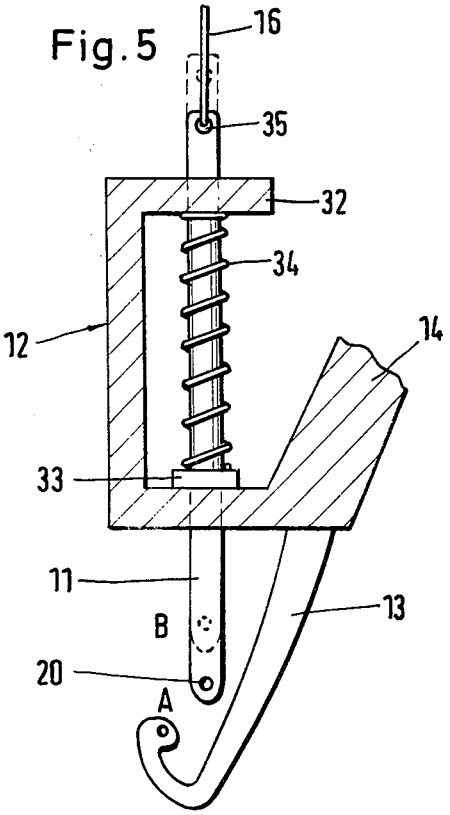
FIG. 5 is a cross sectional view of a guide bar which is an alternate to that of FIG. 1.

FIG. 5 shows a cross section of a particular mode of guide bar. The bar has a substantially U-shaped profile 32, whose lower arm is extended to form the thread guiding bar 14 so that both bars comprise a single structural unit which may be driven by a single pattern wheel. The thread guide 11 is surrounded by a biasing spring 34 which bears against striker portion 33 to urge guide 11 downwardly. An aperture at the upper end of guide 11 for the connection thereto of jacquard cord 16 can draw guide 11 to an upper position, shown in phantom.

The foregoing unitary construction achieves the desirable feature of keeping thread positioning sinkers 13 at a fixed position with respect to guide bar 12, even as it carries out a patterning displacement in the direction of the longitudinal axis of the needle bed. In this manner, a preset arrangement is maintained in the direction of the needle bed axis. Also for swinging motions, attachment of thread positioning bar 14 to guide bar 12 achieves an optimal mutual arrangement between them which, once set, persists regardless of whether these parts swing with respect to a fixed needle bed or, conversely, the needle bed swings with respect to a fixed guide bar and thread patterning bar.

Figure 6B:
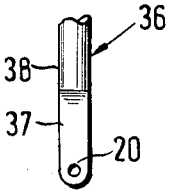
FIG. 6B is a side view of the guide of FIG. 6A.
Figure 6A:
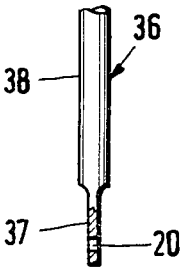
FIG. 6A is a partially sectioned view of a thread guide which is an alternate to that of FIG. 1.

In FIGS. 6A and 6B, thread guide 36 is shown as an alternate to guide 11 (FIG. 2). Guide 36 includes a cylindrical shaft 38 leading to a flattened (or narrowed) tip 37. The narrowed portion 37 is preferably made stiff. Thus arranged, eyelet 20 can be threaded with a conventional insertion comb even when thread guides 36 are very closely spaced. Such a comb has a plurality of spaced, parallel hook needles which can be pushed through eyelets 20. Once inserted, the hooks grab hold of each thread and in the backward movement of the comb, pull them through the appropriate hole.

In other possible embodiments, the illustrated thread guide sinkers may be replaced by other forms thereof, for example, hooks whose free ends are covered by a shoe running in the direction of the length of the machine or, when no substantial thread turning is to be expected, simple pegs.

Hereinbefore has been disclosed an efficient device for rapidly, simply and accurately positioning warp threads in the needle bed of warp knitting machine. It will be understood that various changes in the details, materials, arrangement of parts and operating conditions which have been herein described and illustrated in order to explain the nature of the invention, may be made by those skilled in the art within the principles and scope of the instant invention.

Having thus set forth the nature of the invention what is claimed is:

1. A warp knitting machine having a needle bed and a jacquard arrangement for producing from a plurality of threads, patterned wear, comprising:

(a) a thread positioning bar;

(b) a plurality of thread positioning sinkers mounted on said thread positioning bar and spaced to allow said sinkers to pass between the needles of said bed;

(c) at least one guide bar; and (d) a plurality of thread guides mounted on said guide bar for separately guiding said threads, said thread guides being operable by said jacquard arrangement to move longitudinally relative to said guide bar and with a component of motion in a plane alongside said needle bed, said component being sized to allow each of said threads to reciprocate between and be pulled against the interior sides of a corresponding, neighboring pair of said sinkers.

2. A warp knitting machine according to claim 1 wherein said thread positioning bar and said guide bar are affixed together and mounted to swing together.

3. A warp knitting machine according to claim 1 wherein said thread positioning bar is displaceable in a direction along the length of said needle bed.

4. A warp knitting machine according to claim 3 wherein said thread positioning bar and said guide bar are of a unitary construction.

5. A warp knitting machine according to claim 3 wherein said guide bar comprises at least two members, each being driven by said jacquard arrangement.

6. A warp knitting machine according to claim 5 wherein said thread guides are each mounted in said guide bar at an acute angle with respect to said needle bed, and wherein said jacquard arrangement comprises:

(a) a plurality of control strings each colinearly attached to a corresponding one of said thread guides; and (b) an eyelet bar, said control strings running from said eyelet bar toward said thread guides at said acute angle to said needle bed.

7. A warp knitting machine according to claim 1 wherein each of said sinkers is shaped as a hook terminating in an inwardly directed protrusion.

8. A warp knitting machine according to claim 7 wherein each of said sinkers has an eyelet proximate said protrusion.

9. A warp knitting machine according to claim 8 further comprising a wire routed through the eyelet of each said sinkers and running the breadth of said warp knitting machine.

10. A warp knitting machine according to claim 8 wherein each of said thread guides comprise a shaft having a transversely apertured, narrowed, free end.

* * * * *

UNITED STATES PATENT OFFICE

CERTIFICATE OF CORRECTION

Patent No. 4,417,456 Dated November 29, 1983

Inventor(s) Gerhard Bergmann, Erhard Henz

It is certified that error appears in the above-identified patent and that said Letters Patent are hereby corrected as shown below:

At Item [73] insert:

Assignee: Karl Mayer Textilmaschinenfabrik GmbH
Federal Republic of Germany

Signed and Sealed this

*Seventh* Day of *August 1984*

[SEAL]

*Attest:*

GERALD J. MOSSINGHOFF

*Attesting Officer*

*Commissioner of Patents and Trademarks*